US006553731B2

(12) United States Patent
Hsueh

(10) Patent No.: US 6,553,731 B2
(45) Date of Patent: Apr. 29, 2003

(54) COMBINATION PARTITION SCREEN AND HANGING STRUCTURE FOR USE IN A COMBINATION PARTITION SCREEN

(76) Inventor: Yi-Cheng Hsueh, No. 28-1, Lane 195, Yung Fong Road, Tu Cheng, Taipei Hsien (TW)

( * ) Notice: Subject to any disclaimer, the term of this patent is extended or adjusted under 35 U.S.C. 154(b) by 100 days.

(21) Appl. No.: 09/832,001

(22) Filed: Apr. 11, 2001

(65) Prior Publication Data

US 2001/0029707 A1 Oct. 18, 2001

(30) Foreign Application Priority Data

Apr. 12, 2000 (TW) ..... 89205851 U
Jul. 31, 2000 (TW) ..... 89213242 U

(51) Int. Cl.[7] ..... E04F 19/00; E04B 2/74; E04B 9/00; E04H 1/00; E04C 2/38

(52) U.S. Cl. ..... 52/239; 52/36.4; 52/36.5; 52/242; 52/475.1; 52/481.1; 52/479

(58) Field of Search ..... 52/36.4, 36.5, 52/243.1, 239, 242, 479, 483.1, 475.1, 730.6, 481.1, 481.2, 780

(56) References Cited

U.S. PATENT DOCUMENTS 3,276,175 A * 10/1966 Birum ..... 52/239
3,282,006 A * 11/1966 Halsey ..... 52/781
3,371,454 A * 3/1968 Anderson ..... 52/126.4
3,611,664 A * 10/1971 Barbera ..... 52/481.1
3,685,230 A * 8/1972 Lickliter et al. ..... 52/677
3,696,569 A * 10/1972 Didry ..... 52/126.4
4,026,084 A * 5/1977 Goose ..... 52/780
4,825,601 A * 5/1989 Halverson ..... 52/36.4
5,930,963 A * 8/1999 Nichols ..... 52/239
5,966,299 A * 10/1999 Rhew et al. ..... 363/124
6,401,427 B1 * 6/2002 Snyder ..... 52/764
6,421,961 B1 * 7/2002 Mallozzi ..... 52/36.5
6,490,841 B2 * 12/2002 Hynes ..... 52/729.2

* cited by examiner

*Primary Examiner*—Carl D. Friedman
*Assistant Examiner*—Kevin McDermott
(74) *Attorney, Agent, or Firm*—Troxell Law Office PLLC

(57) ABSTRACT

A combination partition screen includes at least two upright supports, each upright support having a plurality of longitudinal coupling portions in corners thereof and a plurality of spacers respectively mounted between each two adjacent upright supports to support partition panels, each spacer having a flat base wall, a flat bearing wall and a flat supporting wall respectively extended from the base wall, an upward stop flange extended from the flat bearing wall and adapted to hold with the flat base wall a partition panel on the flat bearing wall, a downward stop flange extended from the flat supporting wall and adapted to hold with the flat base wall a partition panel below the flat supporting wall, a downward locating flange extended from the flat bearing wall and defining with the flat supporting wall an elongated coupling chamber for hanging things, a flat positioning wall perpendicularly extended from an opposite side of the flat base wall on the middle, an elongated clamping wall extended from the flat positioning wall, and two coupling notches disposed on two ends of the flat positioning wall between the flat base wall and the flat positioning wall and respectively coupled to two adjacent upright supports.

9 Claims, 7 Drawing Sheets

COMBINATION PARTITION SCREEN AND HANGING STRUCTURE FOR USE IN A COMBINATION PARTITION SCREEN

BACKGROUND OF THE INVENTION

1. Field of the Invention

The present invention relates to a combination partition screen and, more particularly, to such a combination partition screen that can easily quickly be set up. The invention relates also to hanging devices for use on the combination partition screen.

2. Description of Related Art

Partition screens are commonly used to separate the room or house into separated spaces for different purposes for the advantage of low cost, high mobility, and being detachable and highly adjustable.

According to conventional partition screen construction methods, the connection between the partition panels and the upright supports (studs) can be achieved by hanging as indicated in U.S. Pat. No. 5,664,380 (equivalent to Taiwan Patent No. 101835), or engagement as indicated in U.S. Pat. No. 5,855,100 (equivalent to Taiwan Patent No. 141448). According to these two connection methods, coupling elements are provided at the back sidewall of the partition panels for fastening to the front or back side of the upright supports (studs). The use of the coupling elements complicates the procedure of the installation procedure of the partition panels.

Further, due to structural strength problem, it is not suitable to fasten an article, for example, a table board or storage rack to a partition screen with nails or screws. According to U.S. Pat. No. 3,778,939, each stud has flange portions at two opposite sides and slots in the flange portion for the mounting of a bracket selectively, and support boards are respectively supported on brackets between studs for holding things. According to this design, brackets must be mounted on the studs so that storage items can be carried between studs. This design limits the arrangement of storage items.

SUMMARY OF THE INVENTION

The present invention has been accomplished under the circumstances in view. According to one aspect of the present invention, the combination partition screen comprises at least two upright supports, each upright support comprising a plurality of longitudinal coupling portions in corners thereof and a plurality of spacers respectively mounted between each two adjacent upright supports to support partition panels, each spacer comprising a flat base wall, a flat bearing wall and a flat supporting wall respectively extended from the base wall, an upward stop flange extended from the flat bearing wall and adapted to hold with the flat base wall a partition panel on the flat bearing wall, a downward stop flange extended from the flat supporting wall and adapted to hold with the flat base wall a partition panel below the flat supporting wall, a downward locating flange extended from the flat bearing wall and defining with the flat supporting wall an elongated coupling chamber for hanging things, a flat positioning wall perpendicularly extended from an opposite side of the flat base wall on the middle, an elongated clamping wall extended from the flat positioning wall, and two coupling notches disposed on two ends of the flat positioning wall between the flat base wall and the flat positioning wall and respectively coupled to two adjacent upright supports.

According to another aspect of the present invention, the spacers each further comprise a first recessed portion provided in the elongated flat bearing wall between the elongated flat base wall and the upward stop flange at a top side and a second recessed portion in the elongated flat supporting wall between the elongated flat base wall and the downward stop flange at a bottom side for the mounting of packing strips.

Further, carriers may be used to support attached heavy devices. The carriers each comprise a center box and two spacer units at two sides of the center box. The spacer units work same as the spacers.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
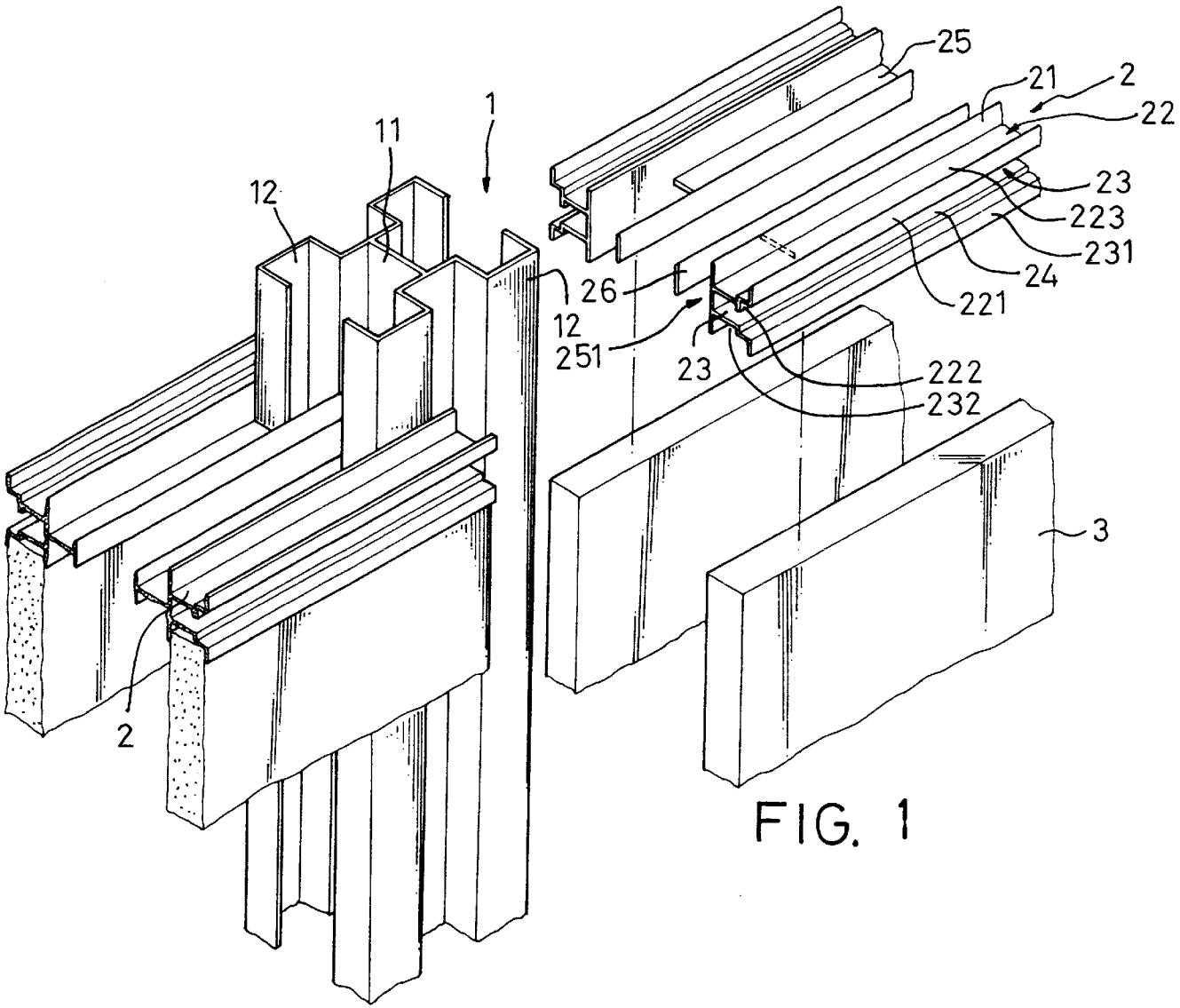
FIG. 1 is an exploded view of a combination partition screen according to the present invention.
Figure 3:
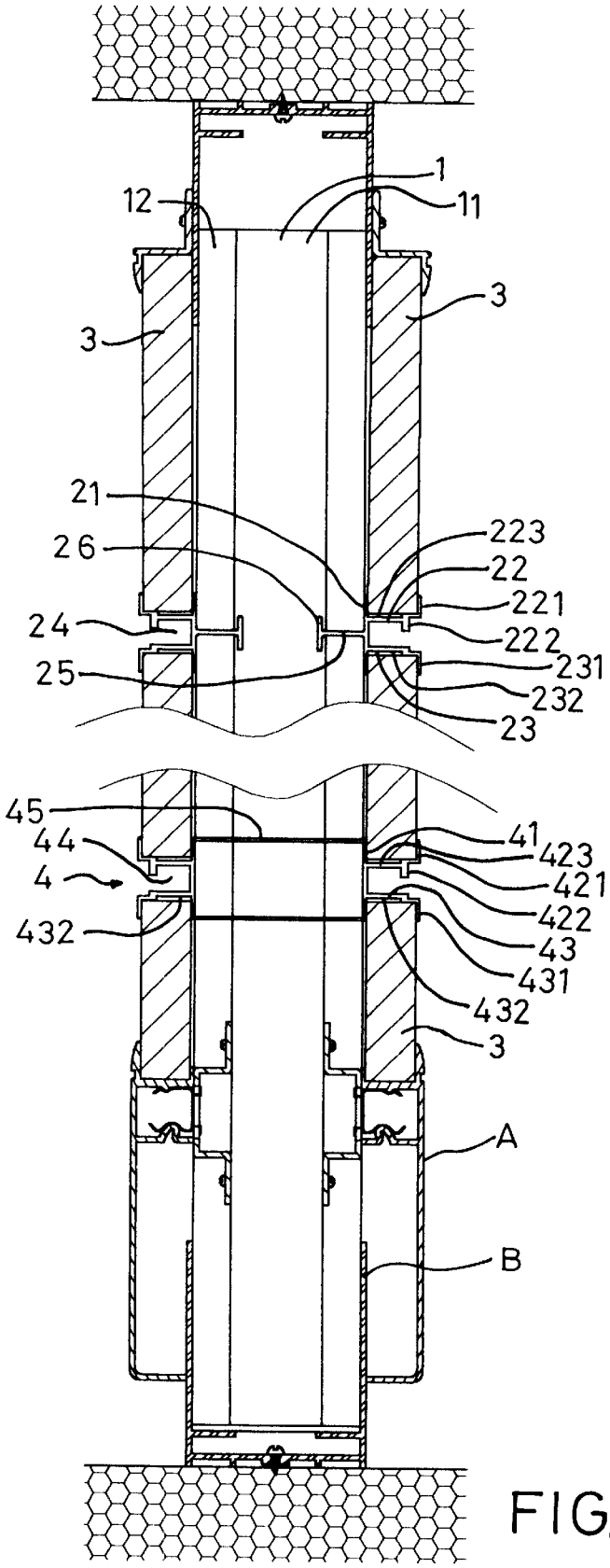
FIG. 3 is a sectional assembly view of the present invention.

Referring to FIG. 1 and FIG. 3, a combination partition screen in accordance with the present invention comprises at least two upright supports 1, a plurality of spacers 2 respectively connected between the upright supports 1, and a partition panel 3 sandwiched in between each two spacers 2.

The upright support 1 is an elongated profiled member comprising a longitudinal base plate 11, and at least two longitudinally extended coupling portions 12 bilaterally disposed at one side of the base plate 11. Preferably, four coupling portions 12 are respectively provided in four corners at two sides of the base plate 11 for the connection of the spacers 2.

The spacer 2 is an elongated profiled member comprising an elongated flat base wall 21, an elongated flat bearing wall 22 perpendicularly extended from the front side of the flat base wall 21, an upward stop flange 221 extended from the free end of the elongated flat bearing wall 22 and adapted to hold with the elongated flat base wall 21 a partition panel 3 on the elongated flat bearing wall 22, an elongated flat supporting wall 23 perpendicularly extended from the front side of the flat base wall 21 below the elongated flat bearing wall 21, a downward stop flange 231 extended from the free end of the elongated flat supporting wall 23 and adapted to hold with the elongated flat base wall 21 a partition panel 3 at the bottom side of the elongated flat supporting wall 23, a downward locating flange 222 extended from the free end of the elongated flat bearing wall 22 and defining with the elongated flat supporting wall 23 an elongated coupling chamber 24.

Furthermore, an elongated flat positioning wall 25 perpendicularly extended from the back side of the elongated flat base wall 21 on the middle, an elongated clamping wall 26 extended along the free end of the elongated flat positioning wall 25, and a coupling notch 251 on each end of the elongated flat positioning wall 25 between the elongated flat base wall 21 and the elongated flat positioning wall 25 fitting the coupling portions 12 of each upright support 1. When forcing the coupling notch 251 on one end of the elongated flat positioning wall 25 of the spacer 2 into engagement with one coupling portion 12 of one upright support 1, the spacer 2 can be moved along the upright support 1 to the desired elevation.

Further, recessed portions 223 and 232 are respectively provided at the top side of the elongated flat bearing wall 22 between the elongated flat base wall 21 and the upward stop flange 221 and the bottom side of the elongated flat supporting wall 23 between the elongated flat base wall 21 and the downward stop flange 231 for the mounting of packing strips (not shown) to facilitate the positioning of the partition panels 3.

Referring to FIG. 3 and FIG. 1 again, the upright supports 1 are respectively fixedly fastened to respective mounting holes B adjacent to respective kick plates A. After one partition panel 3 has been mounted on one kick plate A and stopped between two upright supports 1, one spacer 2 is coupled with its two coupling notches 251 to the two adjacent upright supports 1 and moved downwards along the upright supports 1 to force the elongated flat supporting wall 23 into contact with the topmost edge of the installed partition panel 3, and then a second partition panel 3 is put in between the two adjacent upright supports 1 and supported on the elongated flat bearing wall 22 of the installed spacer 2, and then a second spacer 2 is coupled to the two adjacent upright supports 1 and lowered to force its elongated flat supporting wall 23 into contact with the topmost edge of the second partition panel 3. By means of repeating this procedure, a partition screen is easily set up subject to the desired height. When assembled, the partition panels 3 are respectively stopped in place by the upward stop flange 221 and downward stop flange 231 of each spacer 2. Further, the partition panels 3 can be cut to the desired height so as to change the elevations of the spacers 2 in the combination partition screen to be set up.

Figure 2:
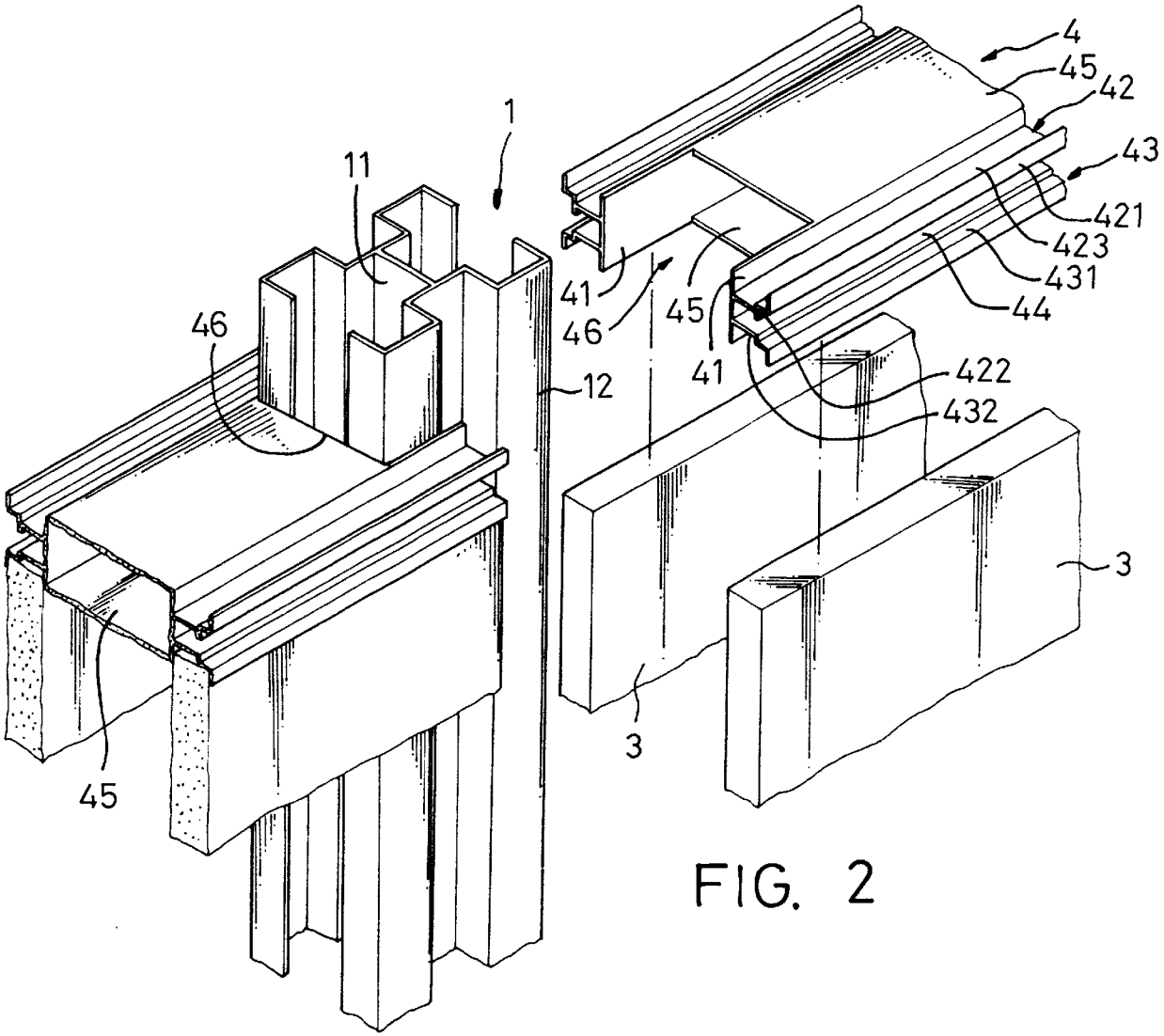
FIG. 2 is an exploded view of an alternate form of the combination partition screen according to the present invention.

Referring to FIG. 2 and FIG. 3, a carrier 4 may be provided between two horizontally aligned spacers 2 to support a heavy object, for example, a table board. The carrier 4 is a flat, hollow, profiled frame member comprising a flat center box 45 corresponding to the width of the upright support 1, two end coupling notches 46 at two ends of the center box 45 corresponding to one half of the depth of the upright support 1, and two spacer units at two sides of the center box 45 and the end coupling notches 46. The structure of the spacer units is similar to the aforesaid spacers 2, each comprising an elongated flat base wall 41, an elongated flat bearing wall 42 perpendicularly extended from the front side of the flat base wall 41, an upward stop flange 421 extended from the free end of the elongated flat bearing wall 42 and adapted to hold with the elongated flat base wall 41 a partition panel 3 on the elongated flat bearing wall 42, an elongated flat supporting wall 43 perpendicularly extended from the front side of the flat base wall 41 below the elongated flat bearing wall 41, a downward stop flange 431 extended from the free end of the elongated flat supporting wall 43 and adapted to hold with the elongated flat base wall 41 a partition panel 4 at the bottom side of the elongated flat supporting wall 43, a downward locating flange 422 extended from the free end of the elongated flat bearing wall 42 and defining with the elongated flat supporting wall 43 an elongated coupling chamber 44. Further, recessed portions 423 and 432 are respectively provided at the top side of the elongated flat bearing wall 42 between the elongated flat base wall 41 and the upward stop flange 421 and the bottom side of the elongated flat supporting wall 43 between the elongated flat base wall 41 and the downward stop flange 431 for the mounting of packing strips (not shown) to facilitate the positioning of the partition panels 3.

The installation of the carrier 4 is outlined thereinafter with reference to FIGS. 2 and 3 again. The end coupling notches 46 of the carrier 4 are respectively coupled to two adjacent upright supports 1, and then the carrier 4 is lowered to force the elongated flat supporting wall 43 of each of the two spacer units thereof against the topmost edge of each partition panel 3 between the two adjacent upright supports 1, and then another two partition panels 3 are coupled to the two adjacent upright supports 1 and respectively supported on the elongated flat bearing wall 42 of each of the two spacer units of the carrier 4. After setting of a combination partition screen, the user can hung things on the spacers 2 or the carriers 4 at either side of the combination partition screen as desired.

Figure 4:
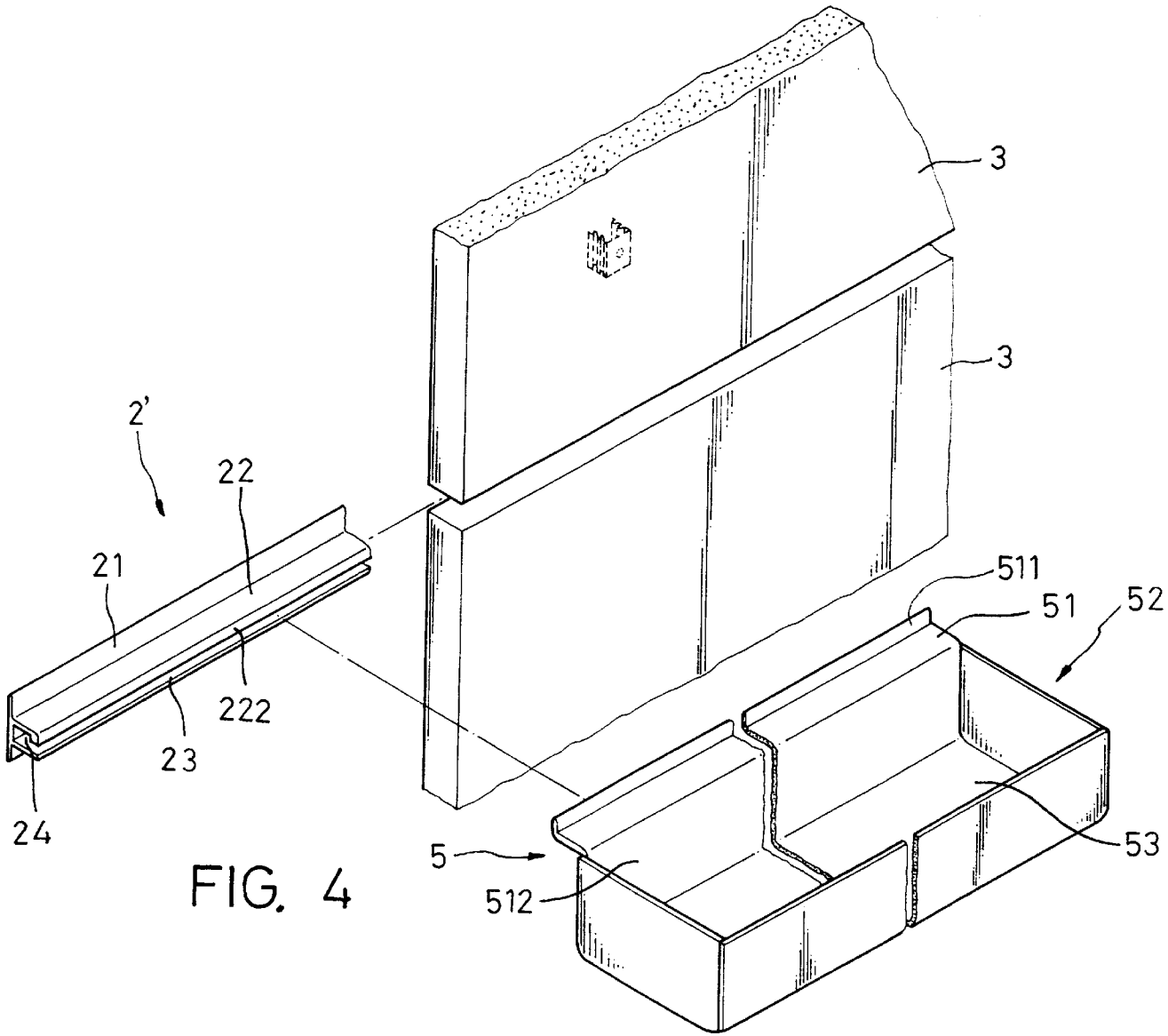
FIG. 4 is an exploded view of another alternate form of the combination partition screen according to the present invention.

FIG. 4 shows an alternate form of the spacer. According to this alternate form, the spacer 2' comprises an elongated flat base wall 21 disposed in contact with the back sidewall of each of two vertically spaced partition panels 3, an elongated flat bearing wall 22 and elongated flat supporting wall 23 perpendicularly extended from the elongated flat base wall 21 at different elevations and supported in between the two vertically spaced partition panels 3, a downward stop flange 222 extended from the free end of the elongated flat bearing wall 22 and defining with the elongated flat base wall 21 and the elongated flat supporting wall 23 an elongated coupling chamber 24.

In the embodiment shown in FIG. 1, the elongated flat bearing wall 22, elongated flat supporting wall 23 and elongated coupling chamber 24 of each spacer 2 form a hanging structure for hanging things. In the embodiment shown in FIG. 2, the elongated flat bearing wall 42, elongated flat supporting wall 43 and elongated coupling chamber 44 of each spacer unit of the carrier 4 form a hanging structure for hanging things. In the embodiment shown in FIG. 4, the elongated flat bearing wall 22, elongated flat supporting wall 23 and elongated coupling chamber 24 of the spacer 2' form a hanging structure for hanging things.

Referring to FIGS. from 4 through 7, a hanging device 5 is hung on the hanging structure of spacer 2' to hold or support things. The hanging device 5 can be a box, rack, or plate member, comprising a vertical back sidewall 512, a horizontal extension plate 51 backwardly extended from the topmost edge of the vertical back sidewall 512, and a coupling flange 511 upwardly extended from the free end of the horizontal extension plate 51 remote from the vertical back sidewall 512. The height of the coupling flange 511 is slightly greater than the distance between the downward stop flange 222 and the elongated flat supporting wall 23. During installation, the coupling flange 511 is inserted into the elongated coupling chamber 24 of the spacer 2', and then the hanging device 5 is turned downwards to force the coupling flange 511 into engagement with the downward stop flange 222 of the spacer 2', keeping the vertical back sidewall 512 supported on the front sidewall of the lower partition panel 3. Further, the front side of the hanging device 5 is provided with a holder 52 adapted to hold or support things.

Figure 5:
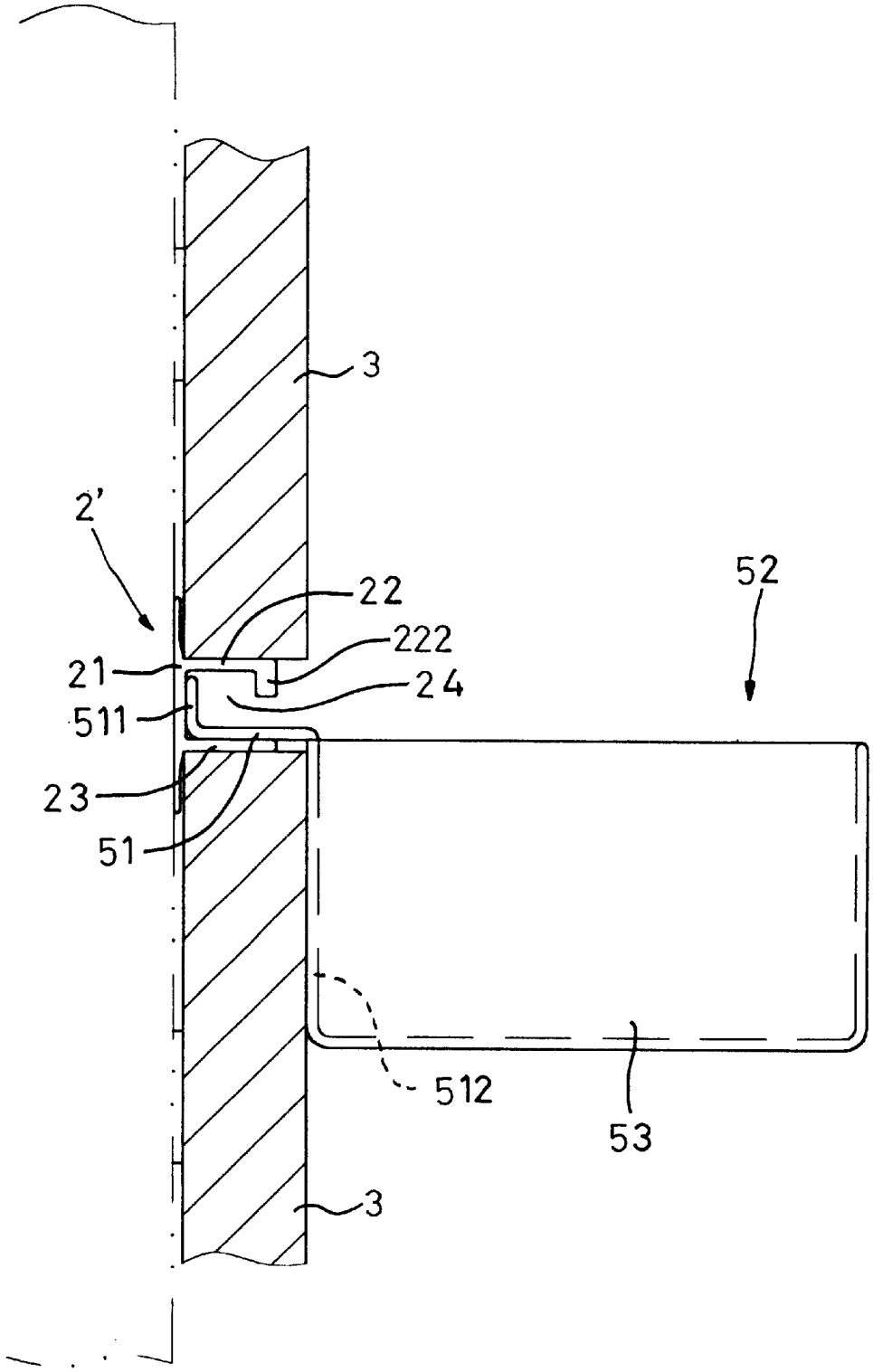
FIG. 5 is a sectional assembly view of FIG. 4.

In the embodiment shown in FIGS. 4 and 5, the holder 52 is a top-open storage box 53 adapted to hold things.

Figure 6:
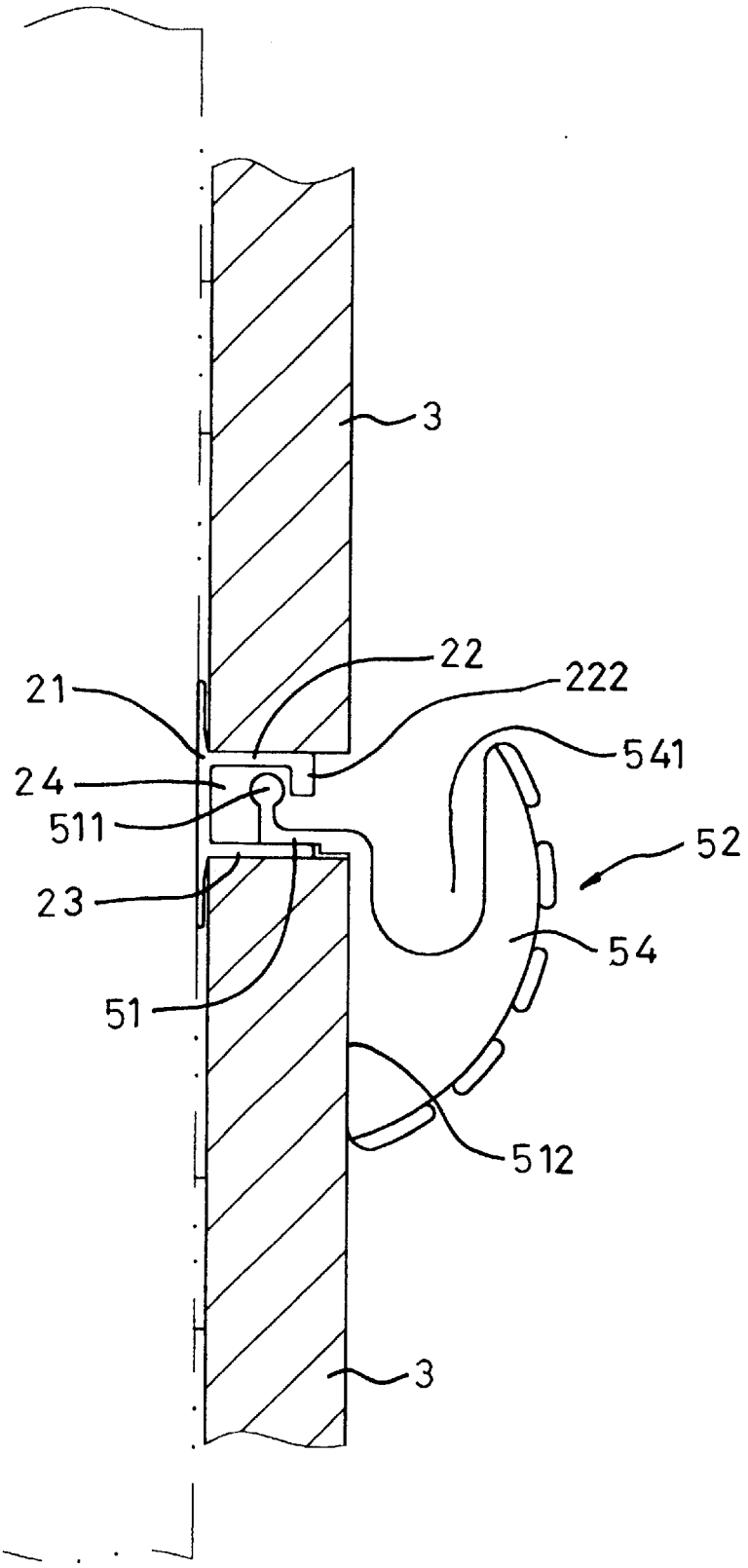
FIG. 6 is a sectional view of the present invention showing an alternate form of the hanging device.

In the embodiment shown in FIG. 6, the holder 52 comprises a hook plate 54 defining a hanging recess 541 adapted to hang things.

Figure 7:
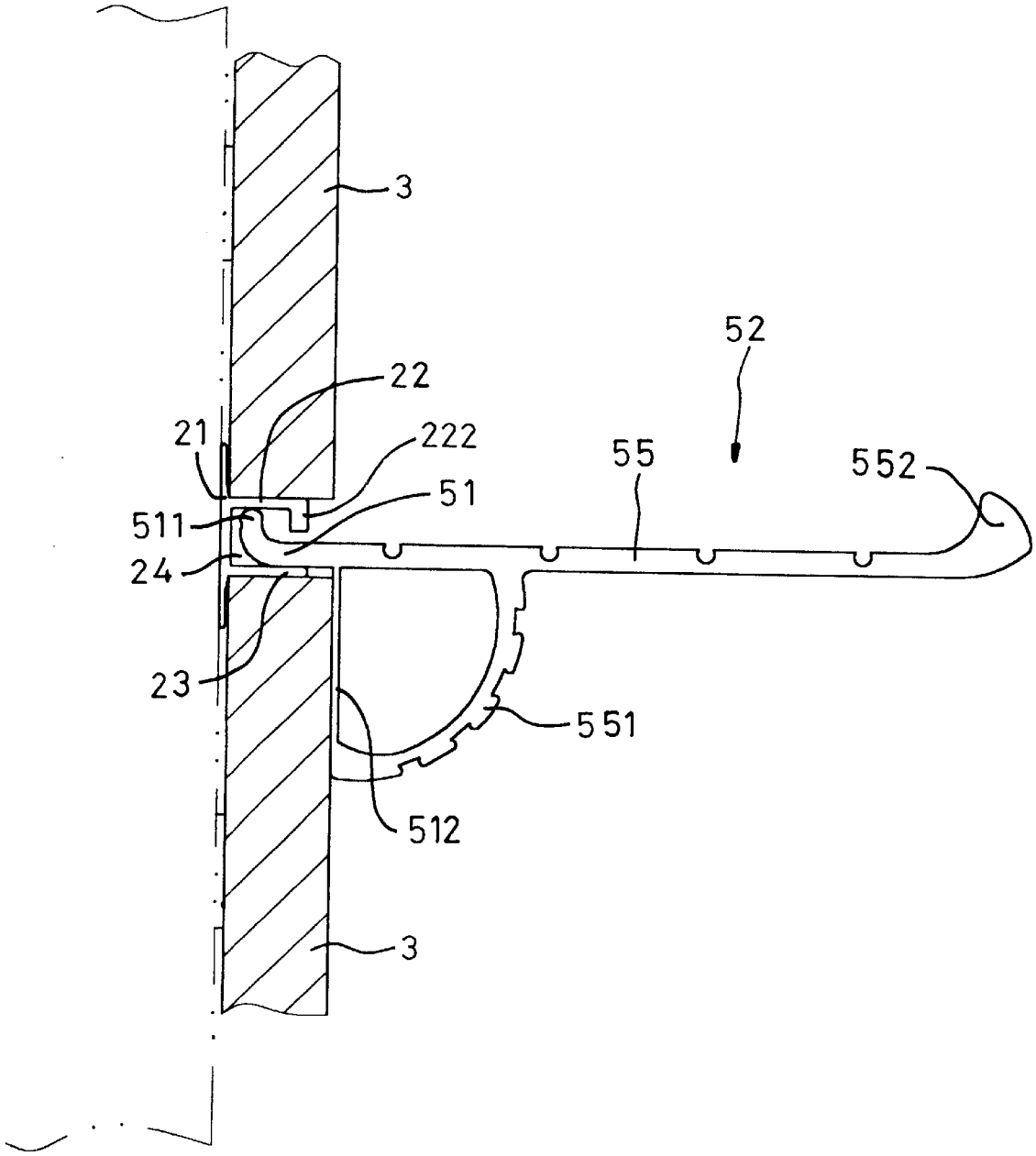
FIG. 7 is a sectional view of the present invention showing another alternate form of the hanging device.

In the embodiment shown in FIG. 7, the holder 52 comprises a bearing plate 55 perpendicularly forwardly extended from the vertical back sidewall 512, and strut 551 connected between the vertical back sidewall 512 and the bearing plate 55 at the bottom side. The bearing plate 55 has an upwardly curved outer stop flange 552 adapted to stop storage things from falling out of the bearing plate 55.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination partition screen comprising:

at least two upright supports, said upright supports each comprising a longitudinally extended base, and at least two longitudinal coupling portions bilaterally disposed about one side of the base of each of said upright supports; and a plurality of spacers respectively mounted between each two upright supports of said at least two upright supports to support partition panels between each two upright supports, said spacers each comprising an elongated flat base wall, an elongated flat bearing wall perpendicularly extended from a front side of said flat base wall, an upward stop flange extended from said elongated flat bearing wall and adapted to hold with said elongated flat base wall a partition panel on said elongated flat bearing wall, an elongated flat supporting wall perpendicularly extended from said flat base wall below said elongated flat bearing wall, a downward stop flange extended from said elongated flat supporting wall and adapted to hold with said elongated flat base wall a partition panel below said elongated flat supporting wall, a downward locating flange extended from said elongated flat bearing wall and defining with said elongated flat supporting wall an elongated coupling chamber, an elongated flat positioning wall perpendicularly extended from an opposite side of said elongated flat base wall on the middle opposite to said elongated flat bearing wall and said elongated flat supporting wall, an elongated clamping wall extended from said elongated flat positioning wall, and two coupling notches disposed at each end of said elongated flat positioning wall between said elongated flat base wall and said elongated flat positioning wall and respectively coupled to two adjacent upright supports.

2. The combination partition screen of claim 1 wherein said upright supports each comprise four coupling portions one of each said coupling portions being disposed in a corresponding corner around the respective base.

3. The combination partition screen of claim 1 wherein said spacers are respectively coupled between each two adjacent upright supports and supported on respective partition panels of different heights at different elevations.

4. The combination partition screen of claim 1 wherein said spacers each further comprise a first recessed portion provided in said elongated flat bearing wall between said elongated flat base wall and said upward stop flange at a top side and a second recessed portion in said elongated flat supporting wall between said elongated flat base wall and said downward stop flange at a bottom side for the mounting of packing strips.

5. A combination partition screen comprising:

at least two upright supports, said upright supports each comprising a longitudinally extended base, and at least two longitudinal coupling portions bilaterally disposed about one side of the base of each of said upright supports; and a plurality of carriers respectively mounted between each two upright supports of said at least two upright supports to support partition panels between each two upright supports, said carriers each comprising a flat center box corresponding to the width of said upright supports, two end coupling notches disposed at two ends of said center box and respectively coupled to two adjacent upright supports, and two spacer units at two sides of said center box and said end coupling notches, said spacer units each comprising an elongated flat base wall, an elongated flat bearing wall perpendicularly extended from a front side of said flat base wall, an upward stop flange extended from said elongated flat bearing wall and adapted to hold with said elongated flat base wall a partition panel on said elongated flat bearing wall, an elongated flat supporting wall perpendicularly extended from said flat base wall below said elongated flat bearing wall, a downward stop flange extended from said elongated flat supporting wall and adapted to hold with said elongated flat base wall a partition panel below said elongated flat supporting wall, a downward locating flange extended from said elongated flat bearing wall and defining with said elongated flat supporting wall an elongated coupling chamber, an elongated flat positioning wall perpendicularly extended from an opposite side of said elongated flat base wall on the middle opposite to said elongated flat bearing wall and said elongated flat supporting wall, an elongated clamping wall extended from said elongated flat positioning wall, and two coupling notches disposed at each end of said elongated flat positioning wall between said elongated flat base wall and said elongated flat positioning wall and respectively coupled to two adjacent upright supports.

6. The combination partition screen of claim 5 wherein said spacer units each further comprise a first recessed portion provided in the respective elongated flat bearing wall between the respective elongated flat base wall and the respective upward stop flange at a top side and a second recessed portion in the respective elongated flat supporting wall between the respective elongated flat base wall and the respective downward stop flange at a bottom side for the mounting of packing strips.

7. A combination partition screen comprising:

at least two upright supports, said upright supports each comprising a longitudinally extended base, and at least two longitudinal coupling portions bilaterally disposed about one side of the base of each of said upright supports;

a plurality of spacers respectively mounted between each two upright supports of said at least two upright supports to support partition panels between each two upright supports, said spacers each comprising an elongated flat base wall, an elongated flat bearing wall perpendicularly extended from a front side of said flat base wall, an upward stop flange extended from said elongated flat bearing wall and adapted to hold with said elongated flat base wall a partition panel on said elongated flat bearing wall, an elongated flat supporting wall perpendicularly extended from said flat base wall below said elongated flat bearing wall, a downward stop flange extended from said elongated flat supporting wall and adapted to hold with said elongated flat base wall a partition panel below said elongated flat supporting wall, a downward locating flange extended from said elongated flat bearing wall and defining with said elongated flat supporting wall an elongated coupling chamber, an elongated flat positioning wall perpendicularly extended from an opposite side of said elongated flat base wall on the middle opposite to said elongated flat bearing wall and said elongated flat supporting wall, an elongated clamping wall extended from said elongated flat positioning wall, and two coupling notches disposed at two ends of said elongated flat positioning wall between said elongated flat base wall and said elongated flat positioning wall and respectively coupled to two adjacent upright supports; and at least one carrier respectively mounted between two adjacent upright supports of said at least two upright supports to support partition panels between two adjacent upright supports, said at least one carrier each comprising a flat center box corresponding to the width of said upright supports, two end coupling notches disposed at two ends of said center box and respectively coupled to two adjacent upright supports, and two spacer units at two sides of said center box and said end coupling notches, said spacer units each comprising an elongated flat base wall, an elongated flat bearing wall perpendicularly extended from a front side of the flat base wall of the respective spacer unit, an upward stop flange extended from the elongated flat bearing wall of the respective spacer unit and adapted to hold with the elongated flat base wall of the respective spacer unit a partition panel on the elongated flat bearing wall of the respective spacer unit, an elongated flat supporting wall perpendicularly extended from the flat base wall of the respective spacer unit below the elongated flat bearing wall of the respective spacer unit, a downward stop flange extended from the elongated flat supporting wall of the respective spacer unit and adapted to hold with the elongated flat base wall of the respective spacer unit a partition panel below the elongated flat supporting wall of the respective spacer unit, a downward locating flange extended from the elongated flat bearing wall of the respective spacer unit and defining with the elongated flat supporting wall of the respective spacer unit an elongated coupling chamber, an elongated flat positioning wall perpendicularly extended from an opposite side of the elongated flat base wall of the respective spacer unit on the middle opposite to the elongated flat bearing wall and elongated flat supporting wall of the respective spacer unit, an elongated clamping wall extended from the elongated flat positioning wall of the respective spacer unit, and two coupling notches disposed at each end of the elongated flat positioning wall between the elongated flat base wall and elongated flat positioning wall of the respective spacer unit and respectively coupled to two adjacent upright supports.

8. The combination partition screen of claim 7 wherein said spacers each further comprise a first recessed portion provided in the respective elongated flat bearing wall between the respective elongated flat base wall and the respective upward stop flange at a top side and a second recessed portion in the respective elongated flat supporting wall between the respective elongated flat base wall and the respective downward stop flange at a bottom side for the mounting of packing strips; said spacer units of each of said at least one carrier each further comprise a first recessed portion provided in the respective elongated flat bearing wall between the respective elongated flat base wall and the respective upward stop flange at a top side and a second recessed portion in the respective elongated flat supporting wall between the respective elongated flat base wall and the respective downward stop flange at a bottom side for the mounting of packing strips.

9. The combination partition screen of claim 7 wherein said spacers are respectively coupled between each two adjacent upright supports and supported on respective partition panels of different heights at different elevations.

* * * * *